US007004722B2

(12) United States Patent
Teramura et al.

(10) Patent No.: US 7,004,722 B2
(45) Date of Patent: Feb. 28, 2006

(54) AXIAL FLOW COMPRESSOR

(75) Inventors: Minoru Teramura, Wako (JP); Junji Takado, Wako (JP); Gensuke Hoshino, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 71 days.

(21) Appl. No.: 10/636,633

(22) Filed: Aug. 8, 2003

(65) Prior Publication Data

US 2004/0028526 A1 Feb. 12, 2004

(30) Foreign Application Priority Data

Aug. 9, 2002 (JP) ..... 2002-232377

(51) Int. Cl.
*F01D 5/20* (2006.01)

(52) U.S. Cl. ..... 415/119; 415/181; 415/220; 415/173.1

(58) Field of Classification Search ..... 415/119, 415/181, 170.1, 171.1, 173.1, 220, 914
See application file for complete search history.

(56) References Cited

U.S. PATENT DOCUMENTS

| | | | | |
|---|---|---|---|---|
| 2,846,137 | A * | 8/1958 | Smith, Jr. | 415/914 |
| 5,137,419 | A | 8/1992 | Waterman | |
| 5,513,952 | A * | 5/1996 | Mizuta et al. | 415/914 |
| 6,338,609 | B1 * | 1/2002 | Decker et al. | 415/173.1 |

* cited by examiner

*Primary Examiner*—Edward K. Look
*Assistant Examiner*—Richard A. Edgar
(74) *Attorney, Agent, or Firm*—Squire, Sanders & Dempsey LLP

(57) ABSTRACT

At least part of the inner circumferential wall of the outer casing is provided with a concave surface opposing the rotor blade tips as seen in a longitudinal section. Typically, each of the rotor blades is provided with aerofoil section, and the compressor is designed as a transonic axial flow compressor. Thereby, a compressive wave is produced upstream of the shockwave so that the Mach number of the flow entering the shockwave can be reduced. As a result, the shockwave is made less severe, and the shockwave loss can be reduced. In particular, because the concave surface is provided in the casing wall as opposed to the case where the concave surface is provided in the negative pressure side of the rotor blade, the reduction in the performance owing to the change in the angle of the airflow entering the passage defined by the concave surface under a partial load condition can be avoided.

3 Claims, 3 Drawing Sheets

AXIAL FLOW COMPRESSOR

TECHNICAL FIELD

The present invention relates to an axial flow compressor that is typically but not exclusively used in gas turbine engines.

BACKGROUND OF THE INVENTION

The rotor blade of a transonic axial flow compressor (such as the one disclosed in U.S. Pat. No. 5,137,419) rotates at a high speed with a suitable gap defined between the tip of the blade and the opposing inner circumferential surface of the outer casing, and the region adjacent to the blade tip is subjected to an extremely complex flow pattern owing to the boundary layers that develop along the surfaces of the outer wall and the blade, the leak flow that flows through the gap defined between the blade tip and the opposing wall surface, and the interferences between these flows. In particular, owing to the interferences between the leak flow produced in the gap between the blade tip and the opposing wall surface and the shockwave produced between adjacent rotor blades, a low momentum region having a certain circumferential expanse is produced behind a rear half of each rotor blade (see FIG. 5), and this not only severely impairs the efficiency of the tip end of each rotor blade but also degrades the surge property of the rotor blade. Furthermore, the egress of such a low momentum region from each rotor blade promotes the development of a boundary layer on a downstream side of the rotor blade, and impairs the aerodynamic property of the stator blade located downstream of the rotor blade.

To eliminate such a problem, it has been proposed to provide a concave surface on the negative pressure side of each rotor blade to redirect the airflow, and to thereby generate a compressive wave upstream of the shockwave (Prandtl-Meyer flow). This reduces the Mach number of the flow directed to the shockwave, and minimizes the shockwave loss. As this measure additionally controls the leak flow in the upstream region of the shockwave where the load on the blade is most pronounced, the leak flow loss is also minimized.

However, according to this prior proposal, a desired result may be achieved only over a certain operating range, but not outside this range because the compressive wave would not be produced as desired outside the limited operating range and hence the loss cannot be reduced to an acceptable extent.

BRIEF SUMMARY OF THE INVENTION

In view of such problems of the prior art, a primary object of the present invention is to provide an improved axial flow compressor which can improve the efficiency of the rotor blades over a wide operating range including a partial load range.

A second object of the present invention is to provide an improved axial flow compressor which can improve the efficiency of the rotor blades without substantially complicating the manufacturing process.

According to the present invention, at least one of these objects can be accomplished by providing an axial flow compressor, comprising: a rotary hub; a plurality of rotor blades extending radially from the rotary hub; and an outer casing having an inner circumferential wall opposing tips of the rotor blades defining a small gap therebetween; wherein at least part of the inner circumferential wall of the outer casing is provided with a concave surface opposing the rotor blade tips as seen in a longitudinal section. Typically, each of the rotor blades is provided with aerofoil section, and the compressor is designed as a transonic axial flow compressor.

Thereby, a compressive wave is produced upstream of the shockwave so that the Mach number of the flow entering the shockwave can be reduced. As a result, the shockwave is made less severe, and the shockwave loss can be reduced. In particular, because the concave surface is provided in the casing wall as opposed to the case where the concave surface is provided in the negative pressure side of the rotor blade, the reduction in the performance owing to the change in the angle of the airflow entering the passage defined by the concave surface under a partial load condition can be avoided.

In particular, according to the present invention, the rotor blade efficiency can be improved over a wide operating range including a partial load condition, and the surge property can be improved significantly.

Preferably, the concave surface comprises a curved surface extending smoothly from a start point located between a leading edge of the rotor blade (0% axial chord position) and a 30% axial chord position to an end point located between a 50% axial chord position and a 80% axial chord position. The stagger angle $\alpha$ between the start and end points of the concave surface is preferably within ±5 degrees of an angle given by the Prandtl-Meyer function.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
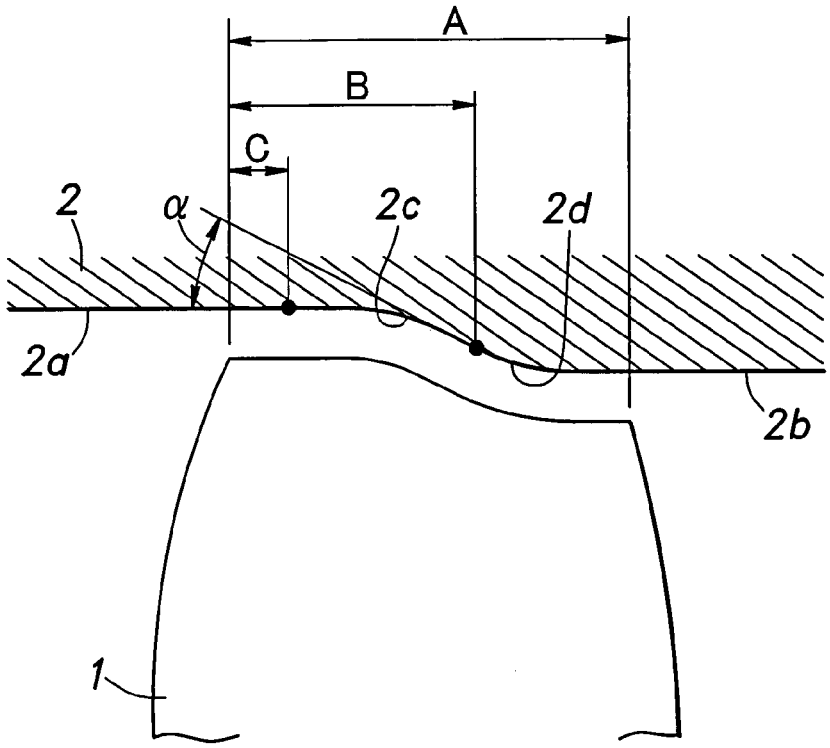
FIG. 1 is a schematic view showing the relationship between an outer casing and a rotor blade in a transonic axial flow compressor.

FIG. 1 is a diagram showing the relationship between an outer casing 2 and a rotor blade 1 of a transonic axial flow compressor when the relative Mach number of the airflow with respect to the tip of the rotor blade 1 and outer casing is 1.5. A certain gap is defined between the tip of the rotor blade 1 and the inner circumferential surface of the outer casing 2.

The cylindrical inner circumferential surface 2*a* of the outer casing 2 upstream of the leading edge of the rotor blade 1 is smoothly connected to the cylindrical inner circumferential surface 2*b* of the outer casing 2 downstream of the trailing edge of the rotor blade 1 by a curved surface having a substantially S-shaped longitudinal section. When the axial length A of the tip of the rotor blade 1 is given as a 100% axial chord length, this curved surface comprises a concave surface 2*c* (as seen in the longitudinal sectional view) consisting of a simple arc having a starting point located at a 20% chord position (a region having length C) as measured from the leading edge (0% chord position) and an end point located at a 72% chord position (a region having length B) as measured from the leading edge (0% chord position), and a convex surface 2*d* (as seen in the longitudinal sectional view) smoothly connecting the end point with the cylindrical inner circumferential surface 2*b* of the outer casing 2 downstream of the trailing edge of the rotor blade 1. The tangent line that passes through the end point defines an angle $\alpha$=12 (deg) with respect to the cylindrical inner circumferential surface of the outer casing upstream of the start point.

A desired result can be achieved if the concave surface comprises a curved surface extending smoothly from a start point located between a leading edge of the rotor blade (0% axial chord position) and a 30% axial chord position to an end point located between a 50% axial chord position and a 80% axial chord position.

Figure 5:
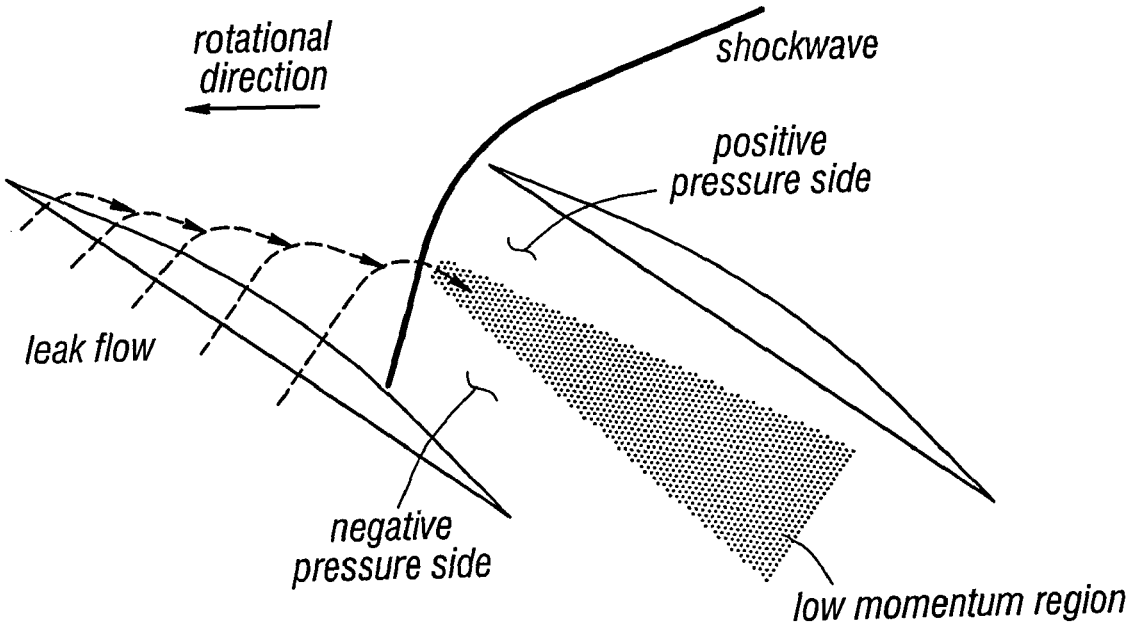
FIG. 5 is a diagram showing the state of airflow near the tip of the rotor blade.

To generate a compressive wave upstream of the shockwave and reduce the Mach number of the flow that is directed to the shockwave, the inner circumferential surface of the outer casing 2 is required to be concave up to the point where the shockwave attaches to the negative pressure surface of the rotor blade 1 (typically, up to a 70% axial chord position). Therefore, the start point of the concave surface should be more upstream than the low momentum region resulting from the interference between the shockwave and blade tip leak flow or a 30% axial chord position from the leading edge of the rotor blade 1 (see FIG. 5).

On the other hand, if the end point is too downstream (larger B), the downstream passage extending between the end point and the cylindrical inner circumferential 2*b* on the downstream end becomes so short that the curvature of the convex surface 2*d* necessarily increases. As this promotes separation at the time of acceleration and deceleration, the end point of the concave surface 2*c* is desired to be confined to a 50% to 80% axial chord position as measured from the leading edge of the rotor blade 1.

Figure 2:
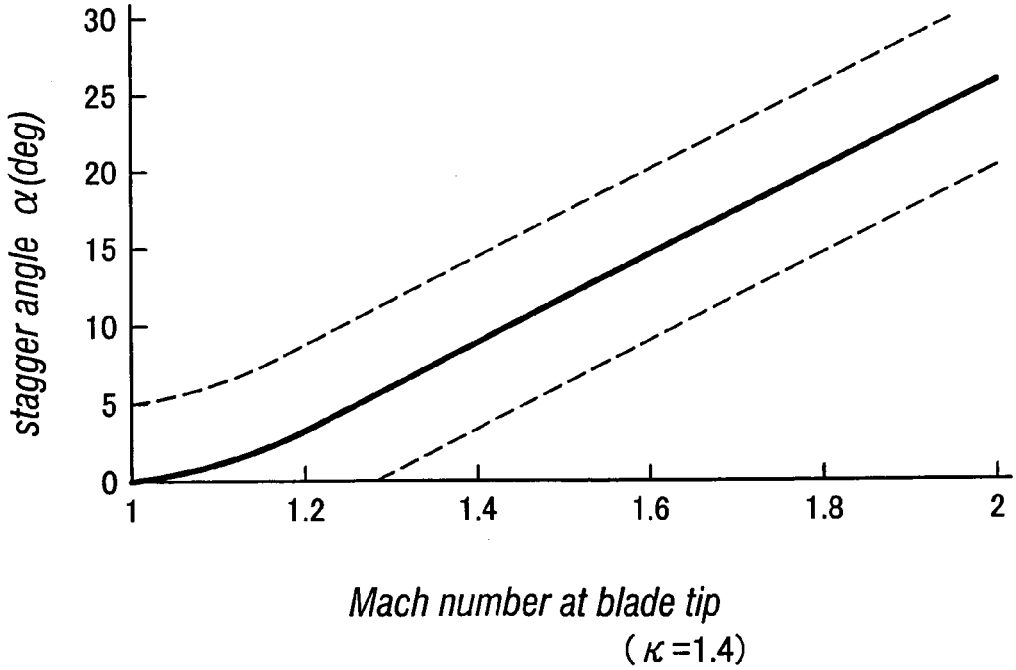
FIG. 2 is a graph showing the relationship between the stagger angle and the relative Mach number of the incoming flow at the tip of the rotor blade.

The stagger angle $\alpha$ between the start and end points is essentially based on the angle given by the Prandtl-Meyer function, but as shown in FIG. 2 for the case where $\kappa$=1.4, the Mach number of the flow entering the shockwave cannot be reduced if this angle is excessively small, and separation at the time of acceleration/deceleration occurs if this angle is excessively great and the curvature of the convex surface 2*d* downstream of the end point thereby becomes excessive. Therefore, this angle should be within ±5 degrees of the basic angle given by the Prandtl-Meyer function as indicated by a region surrounded by the broken lines in FIG. 2.

The Prandtl-Meyer function that gives the basic angle $\nu$ is shown in the following.

$$\nu = \sqrt{\frac{\kappa+1}{\kappa-1}} \cdot \tan^{-1}\sqrt{\frac{\kappa-1}{\kappa+1}(M^2-1)} - \tan^{-1}\sqrt{M^2-1}$$

where M is the Mach number and $\kappa$ is the specific heat ratio.

Figure 3:
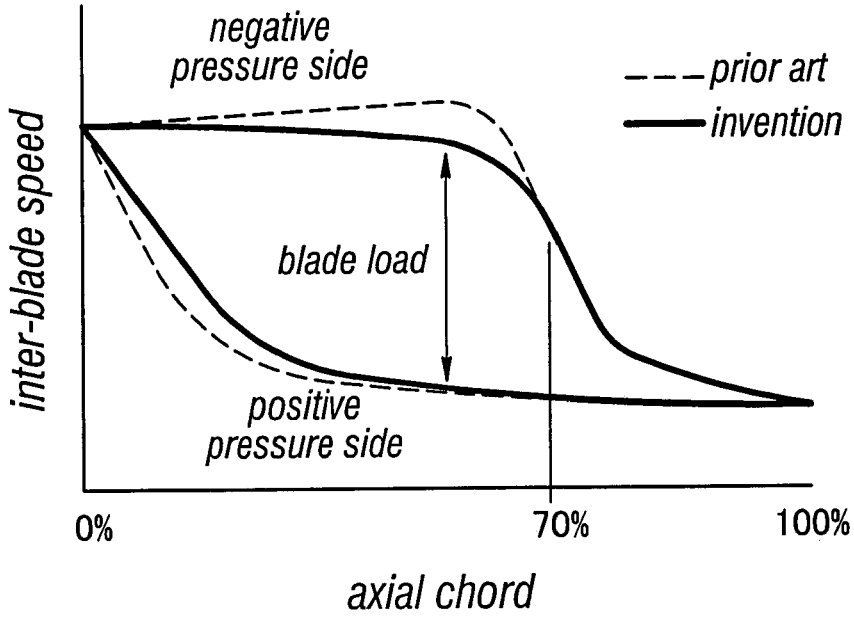
FIG. 3 is a graph showing the distribution of the inter-blade speed near the tip of the rotor blade.

By using an outer casing 2 provided with a concave surface 2*c* as prescribed above, the inter-blade speed on the negative pressure side is significantly reduced up to about a 70% chord position as compared with the prior art as shown in FIG. 3. In other words, because the concave surface based on the present invention can reduce the Mach number of the flow that enters the shockwave, the shockwave is made less severe, and the shockwave loss can be reduced. Also, because the blade load in the upstream region of the shockwave where the greatest blade load occurs can be reduced, and the leak flow from the tip of each rotor blade can be controlled, the leak flow loss can be minimized. Additionally, the development of a low momentum region and a surface boundary layer owing to the interference between the shockwave and leak flow can be controlled.

Figure 4:
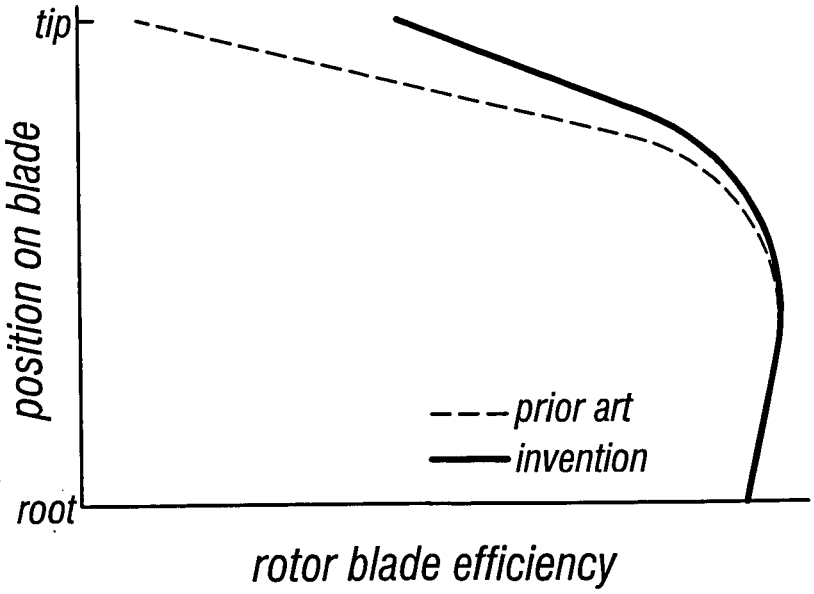
FIG. 4 is a graph showing the rotor blade efficiency with respect to the lengthwise position on the rotor blade.

Because the concave wall surface of the passage prevents the angle of the flow into the region defined by the concave surface from varying under a partial load condition, the reduction in the performance under the partial load condition can be avoided. When the Mach number of the incoming flow decreases under a partial load condition, the stagger angle $\alpha$ of the concave surface may deviate from the optimum value with respect to the Mach number of the incoming flow, the throttling effect of the concave surface prevents the development of a surface boundary layer and the resulting reduction in the efficiency so that the rotor blade efficiency can be maintained substantially as designed even under a partial load condition (see FIG. 4). The surge property which is often impaired under a partial load condition is also improved.

Although the present invention has been described in terms of preferred embodiments thereof, it is obvious to a person skilled in the art that various alterations and modifications are possible without departing from the scope of the present invention which is set forth in the appended claims.

The invention claimed is:

1. An axial flow compressor, comprising:

a rotary hub;

a plurality of rotor blades extending radially from said rotary hub; and an outer casing having an inner circumferential wall opposing tips of said rotor blades defining a small gap therebetween, wherein said inner circumferential wall of said outer casing opposing the tips of said rotor blades comprises, as seen in a longitudinal section, of a cylindrical large diameter section disposed in an upstream section and having a starting point located from a leading edge of the tips of said rotor blades, a cylindrical small diameter section having a smaller diameter than said large diameter section disposed in a downstream section, and an intermediate section having a diameter that monotonically decreases from an upstream end to a downstream end, in a continuous manner, the intermediate section being provided with a concave surface opposing said rotor blade tips as seen in a longitudinal section said concave surface comprises a curved surface extending smoothly from a start point located between a leading edge of the rotor blade (0% axial chord position) and a 30% axial chord position to an end point located between a 50% axial chord position and a 80% axial chord position, and a stagger angle $\alpha$ between tangential lines at the start and end points of the concave surface is within ±5 degrees of an angle given by the Prandtl-Meyer function.

2. An axial flow compressor according to claim 1, wherein each of said rotor blades is provided with aerofoil section.

3. An axial flow compressor according to claim 1, wherein said compressor is designed as a transonic axial flow compressor.

* * * * *